US011476068B2

(12) United States Patent
Mori et al.

(10) Patent No.: US 11,476,068 B2
(45) Date of Patent: Oct. 18, 2022

(54) ELECTROMAGNETIC RELAY WITH HEAT DISSIPATION STRUCTURE

(71) Applicant: OMRON Corporation, Kyoto (JP)

(72) Inventors: Shingo Mori, Yamaga (JP); Ryota Minowa, Yamaga (JP); Yasuo Hayashida, Kumamoto (JP); Naoki Kawaguchi, Yame (JP); Kohei Otsuka, Omuta (JP); Hiroyuki Iwasaka, Kamimashiki (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 17/283,253

(22) PCT Filed: Sep. 18, 2019

(86) PCT No.: PCT/JP2019/036489
§ 371 (c)(1),
(2) Date: Apr. 7, 2021

(87) PCT Pub. No.: WO2020/075454
PCT Pub. Date: Apr. 16, 2020

(65) Prior Publication Data

US 2021/0343493 A1 Nov. 4, 2021

(30) Foreign Application Priority Data

Oct. 10, 2018 (JP) ..... JP2018-192042

(51) Int. Cl.
*H01H 50/12* (2006.01)
*H01H 50/02* (2006.01)
(Continued)

(52) U.S. Cl.
CPC ..... *H01H 50/12* (2013.01); *H01H 50/02* (2013.01); *H01H 50/36* (2013.01); *H01H 50/54* (2013.01)

(58) Field of Classification Search
CPC ..... H01F 27/22; H01F 50/12
(Continued)

(56) References Cited

U.S. PATENT DOCUMENTS 5,546,061 A * 8/1996 Okabayashi ..... H01H 9/443 335/126
6,411,184 B1 * 6/2002 Comtois ..... H01H 50/045 335/133
(Continued)

FOREIGN PATENT DOCUMENTS

JP 49-24965 U 3/1974
JP 49-28159 U 3/1974
(Continued)

OTHER PUBLICATIONS

The International Search Report of International Application No. PCT/JP2019/036489 dated Nov. 19, 2019.
(Continued)

*Primary Examiner* — Alexander Talpalatski
(74) *Attorney, Agent, or Firm* — Shinjyu Global IP

(57) ABSTRACT

An electromagnetic relay includes a fixed terminal, a movable contact piece, a housing, and a heat dissipation structure. The fixed terminal includes a first surface, a second surface opposite the first surface, and a fixed contact disposed on the first surface. The movable contact piece includes a movable contact that is configured to contact the fixed contact. The housing includes an accommodation space accommodating a portion of the fixed terminal, the fixed contact, and the movable contact piece. The heat dissipation structure includes a heat dissipation space that is
(Continued)

provided on the second surface of the fixed terminal for dissipating the heat of the fixed terminal to an outside of the accommodation space.

8 Claims, 8 Drawing Sheets

(51) Int. Cl.
*H01H 50/36* (2006.01)
*H01H 50/54* (2006.01)

(58) Field of Classification Search
USPC ..... 335/126, 131
See application file for complete search history.

(56) References Cited

U.S. PATENT DOCUMENTS 8,461,950 B2 * 6/2013 Lim ..... H01H 33/64 335/131
8,937,518 B2 * 1/2015 Suzuki ..... H01H 9/443 335/131
9,443,685 B2 * 9/2016 Yamamoto ..... H01H 51/00
2009/0321130 A1 * 12/2009 Greer, Jr. ..... H05K 7/20409 174/526
2013/0207750 A1 * 8/2013 Daitoku ..... H01H 9/40 335/126
2013/0240495 A1 * 9/2013 Yano ..... H01H 9/443 219/123
2014/0247099 A1 * 9/2014 Carrete ..... H01H 50/12 335/156
2018/0166211 A1 * 6/2018 Takatsuji ..... H02M 1/143
2018/0330906 A1 * 11/2018 Hiramitsu ..... H05K 7/20272
2018/0350512 A1 * 12/2018 Yang ..... H01F 27/2876

FOREIGN PATENT DOCUMENTS

JP 54-76940 U 5/1979
JP 7-282705 A 10/1995
JP 2012-199095 A 10/2012
JP 2014-120398 A 6/2014
JP 6300153 B2 3/2018

OTHER PUBLICATIONS

The Written Opinion of the International Searching Authority of International Application No. PCT/JP2019/036489 dated Nov. 19, 2019.

* cited by examiner

ELECTROMAGNETIC RELAY WITH HEAT DISSIPATION STRUCTURE

CROSS-REFERENCE TO RELATED APPLICATION

This application is the U.S. National Phase of International Application No. PCT/JP2019/036489, filed on Sep. 18, 2019. This application claims priority to Japanese Patent Application No. 2018-192042, filed Oct. 10, 2018. The contents of those applications are incorporated by reference herein in their entireties.

FIELD

The present invention relates to an electromagnetic relay.

BACKGROUND

Conventionally, relays are known that open and close an electric circuit. The electromagnetic relay described in Japanese Patent No. 6300153 has a fixed terminal including a fixed contact, a movable contact piece including a movable contact, a drive shaft, and an electromagnetic drive device including a coil. The movable contact piece is connected to the drive shaft to be integrally movable with it. Driving of the electromagnetic drive device causes the movable contact piece to move with the drive shaft, and the fixed contact contacts or separates from the movable contact, resulting in closing or opening the electric circuit.

While the fixed contact is in contact with the movable contact, i.e., during energization, the components including the fixed terminal, the movable contact piece, and the coil of the electromagnetic drive device generate heat. In order to efficiently release the heat generated by the coil of the electromagnetic drive device to the case during energization, Japanese Patent No. 6300153 discloses a configuration in which an intervening member having a higher thermal conductivity than air is placed in the gap between the electromagnetic drive device and the case in which the electromagnetic drive device is housed.

In Japanese Patent No. 6300153, even if the heat generated in the coil of the electromagnetic drive device during energization can be efficiently dissipated to the case, it is difficult to efficiently release the heat generated in the fixed terminal and movable contact piece during energization.

The issue the present invention addresses is to provide an electromagnetic relay capable of efficiently releasing the heat generated in the fixed terminal and movable contact piece during energization.

SUMMARY (1) An electromagnetic relay according to one aspect of the present invention includes a first fixed terminal, a movable contact piece, a housing, and a heat dissipation structure. The fixed terminal includes a first surface, a second surface opposite to the first surface, and a fixed contact disposed on the first surface. The movable contact piece includes a movable contact configured to contact the fixed contact. The housing includes an accommodation space accommodating a portion of the fixed terminal, the fixed contact, and the movable contact piece. The heat dissipation structure includes a heat dissipation space provided on the second surface side of the fixed terminal for dissipating the heat of the fixed terminal to an outside of the accommodation space.

In this electromagnetic relay, since the heat dissipation space for dissipating the heat of the fixed terminal is provided on the second surface side of the fixed terminal, the heat generated in the fixed terminal during energization can be efficiently dissipated from the second surface side of the fixed terminal to the outside of the accommodation space. In addition, the heat of the movable contact piece can be efficiently dissipated outside the accommodation space through the fixed terminal.

(2) Preferably, the heat dissipation structure further includes a heat conduction member that is disposed in the heat dissipation space and that has a higher thermal conductivity than air. In this case, the heat conduction member enables the heat generated in the fixed terminal, during energization, to be dissipated more efficiently from the second surface side of the fixed terminal to the outside of the accommodation space.

(3) Preferably, the heat conduction member is disposed in contact with at least one of the housing and the fixed terminal. In this case, since the heat conduction member is arranged in contact with at least one of the housing and the fixed terminal, the heat generated in the fixed terminal, during energization, can be further efficiently dissipated outside the accommodation space.

(4) Preferably, the heat dissipation structure further includes a vent connecting the heat dissipation space to the outside of the housing. In this case, the heat generated in the fixed terminal, during energization, can be more efficiently dissipated from the heat dissipation space to the outside of the accommodation space.

(5) Preferably, the electromagnetic relay further includes a contact case, the case defining the accommodation space and the heat dissipation space and supporting the fixed terminal, and the heat dissipation space is disposed adjacent to the accommodation space. In this case, the heat generated in the fixed terminal can be efficiently dissipated to the heat dissipation space through the contact case.

(6) Preferably, the electromagnetic relay further includes a drive shaft and an electromagnetic drive device. The drive shaft is movable with the movable contact piece in a first direction in which the movable contact contacts the fixed contact, and in a second direction in which the movable contact separates from the fixed contact. The electromagnetic drive device moves the drive shaft in the first and second directions. The contact case includes a bottom and a contact support portion that is disposed on the second direction side of the bottom for supporting the fixed terminal. The fixed terminal has its second surface that is supported by the contact support portion of the contact case. The heat dissipation space is disposed on the first direction side of the contact support portion. In this case, the contact support portion allows the space on the first direction side of the contact support portion to be effectively used as a heat dissipation space.

(7) Preferably, the electromagnetic drive device includes a yoke disposed on the first direction side of the heat dissipation space, and the heat dissipation space is surrounded by the contact support portion of the contact case and the yoke. In this case, the heat generated in the fixed terminal, during energization, can be dissipated to the yoke.

(8) Preferably, the electromagnetic relay further includes a contact case, a drive shaft, and an electromagnetic drive device. The contact case defines the accommodation space and the heat dissipation space. The drive shaft is movable with the movable contact piece in a first direction in which the movable contact contacts the fixed contact, and in a second direction in which the movable contact separates from the fixed contact. The electromagnetic drive device includes a yoke that is disposed on the first direction side of the heat dissipation space and that moves the drive shaft in the first and second directions. The contact case includes a bottom and a contact support portion disposed on the second direction side of the bottom for supporting the fixed terminal. The fixed terminal is, at the second surface, supported by the contact support portion of the contact case. The heat dissipation space is disposed on the first direction side of the contact support portion and adjacent to the accommodation space. The heat conduction member is disposed in contact with at least one of the contact case and the yoke. In this case, since the heat conduction member is disposed in contact with at least one of the contact case and the yoke, the heat of the fixed terminal, during energization, can be further efficiently dissipated outside the accommodation space.

(9) Preferably, the heat dissipation structure further includes a vent connecting the heat dissipation space to the outside of the housing. In this case, in addition to the above effects, the heat generated in the fixed terminal, during energization, can be more efficiently dissipated from the heat dissipation space to the outside of the accommodation space.

DETAILED DESCRIPTION

Figure 1:
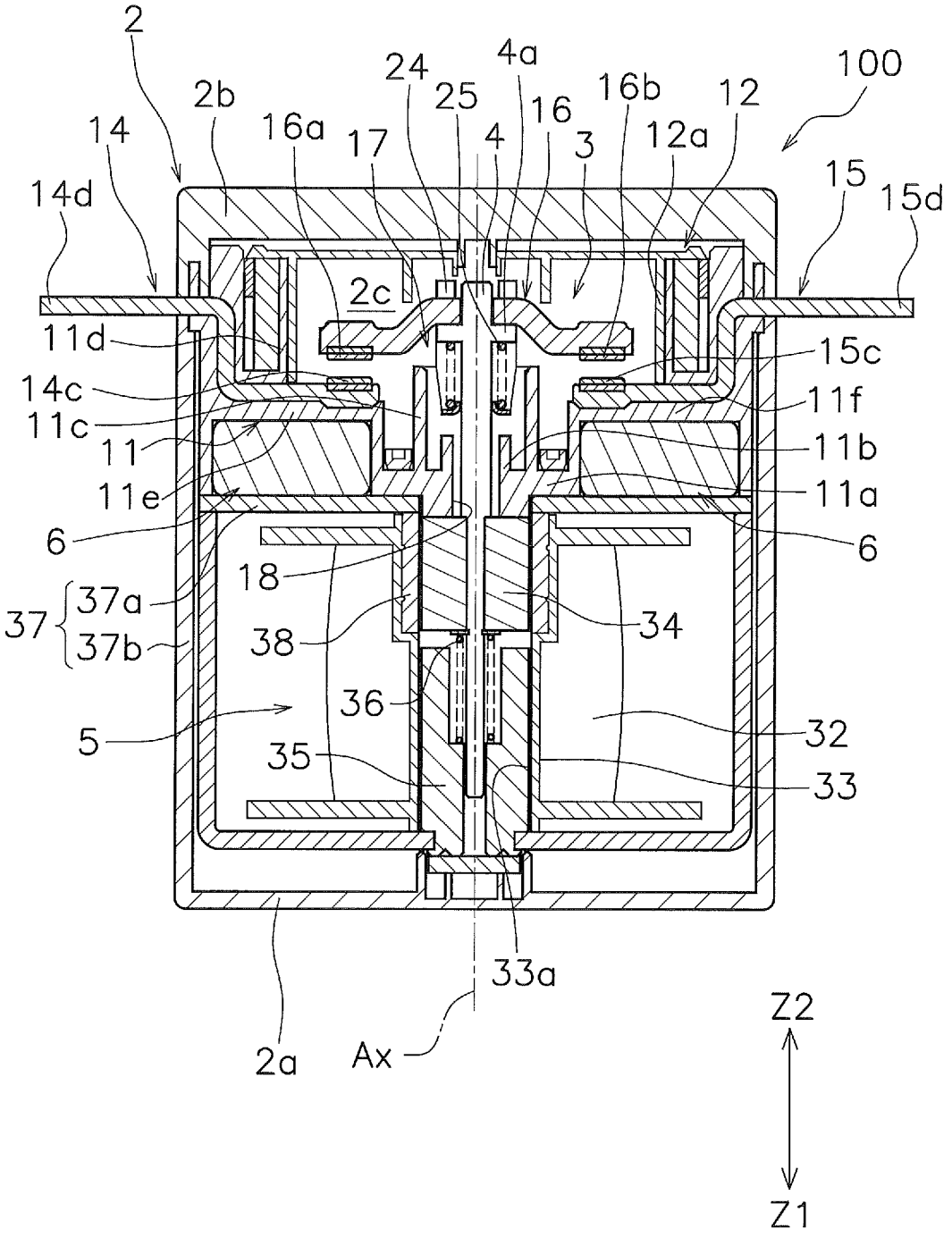
FIG. 1 is a cross-sectional view of an electromagnetic relay according to an embodiment of the present invention.

The following is an embodiment of an electromagnetic relay according to one aspect of the present invention, which will be described with reference to the drawings. FIG. 1 is a cross-sectional view of an electromagnetic relay 100. As shown in FIG. 1, the electromagnetic relay 100 includes a housing 2, a contact device 3, a drive shaft 4, an electromagnetic drive device 5, and a heat dissipation structure 6. In the following description, the direction in which the axis line Ax of the drive shaft 4 extends is referred to as the "axial direction." When referring to the drawings, the upper side in FIG. 1 is referred to as "up", the lower side as "down", the left side as "left", and the right side as "right" for the sake of clarity. In this embodiment, the downward direction in FIG. 1 corresponds to the contact direction Z1. The upward direction in FIG. 1 corresponds to the separating direction Z2 in FIG. 1. The details of the contact direction Z1 and the separating direction Z2 will be described later.

The housing 2 includes a case 2*a* and a cover 2*b*. The case 2*a* is an approximately rectangular box and is open at the top. The cover 2*b* covers the upper part of the case 2*a*. The housing 2 is sealed inside by the case 2*a* and cover 2*b*. The case 2*a* and cover 2*b* are comprised of insulating material. The contact device 3, the drive shaft 4, and the electromagnetic drive device 5 are housed inside the housing 2.

The housing 2 includes an accommodation space 2*c* for accommodating the contact device 3. The accommodation space 2*c* is enclosed, in this embodiment, by a contact case 11 and a contact cover 12 both disposed in the housing 2. The contact case 11 and the contact cover 12 are comprised of insulating material.

Figure 2:
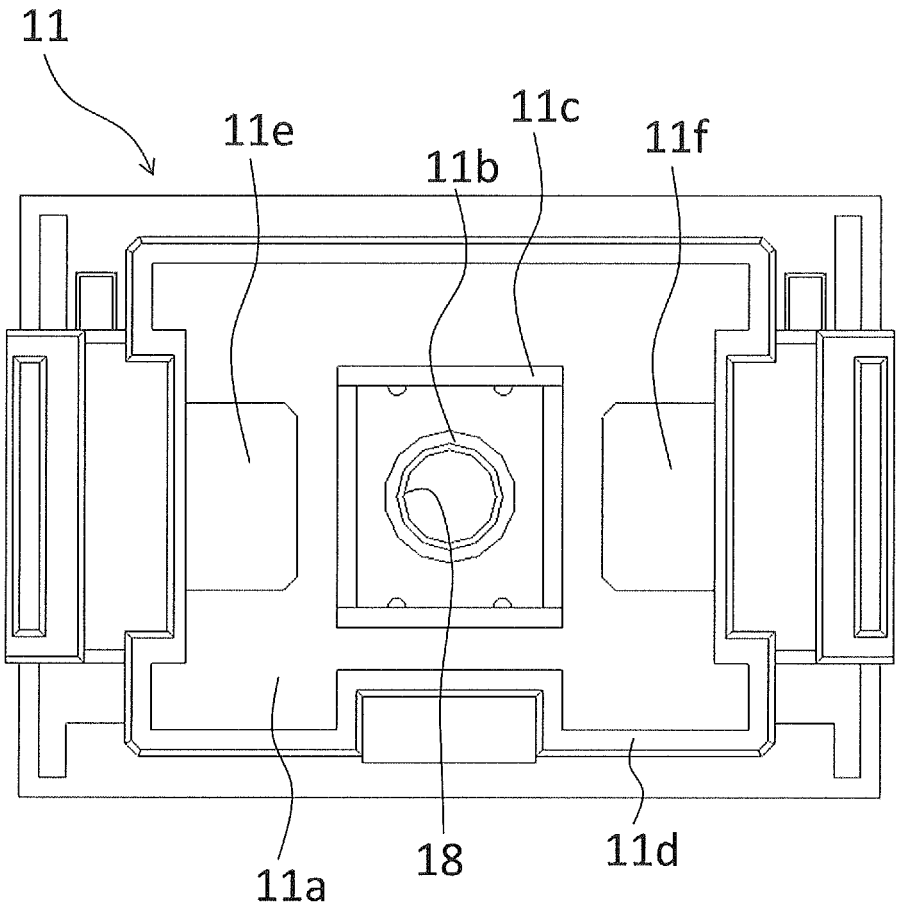
FIG. 2 is a plan view of a contact case.

FIG. 2 is a plan view of the contact case 11. As shown in FIGS. 1 and 2, the contact case 11 includes a bottom 11*a*, a cylindrical part 11*b*, an inner wall 11*c*, and an outer wall 11*d*. The bottom 11*a* is rectangular and plate-shaped. The bottom 11*a* has a longitudinal direction that corresponds to the left-right direction in FIG. 1.

The cylindrical part 11*b* extends in the axial direction in a cylindrical shape. The cylindrical part 11*b* protrudes downward from the center of the bottom 11*a* and upward from the center of the bottom 11*a*. The cylindrical part 11*b* has a through hole 18 penetrating the bottom 11*a* in the axial direction. The through hole 18 axially penetrates the center of the bottom 11*a*. The drive shaft 4 passes through the through hole 18 axially.

The inner wall 11*c* is rectangular in a plan view and extends upward in a plate form from the bottom 11*a* to surround the outer circumference of the cylindrical part 11*b*. The inner wall 11*c* extends upward beyond the cylindrical part 11*b*. The space enclosed by the inner wall 11*c* accommodates a part of a contact piece holding unit 17 which will be described later.

The outer wall 11*d* is located at a position from the cylindrical part 11*b* farther than the inner wall 11*c*. The outer wall 11*d* extends upward in a plate form from the bottom 11*a*. The outer wall 11*d* has an approximately rectangular shape in a plan view and extends upward beyond the inner wall 11*c*.

The contact case 11 further includes a first contact support portion 11*e* and a second contact support portion 11*f*. The first contact support portion 11*e* is disposed to the left of the center of the bottom 11*a* in the longitudinal direction. The first contact support portion 11*e* has a rectangular shape and protrudes upward from the bottom 11*a*. The first contact support portion 11*e* is configured to penetrate a portion of the outer wall 11*d* in the left-right direction. The first contact support portion 11*e* is disposed opposite the inner wall 11*c* in the left-right direction. The second contact support portion 11*f* is symmetrical in shape to the first contact support portion 11*e*, and is therefore omitted from the description.

The contact cover 12 covers the upper part of the contact case 11. The contact cover 12 includes an arc extending wall 12*a* extending toward the bottom 11*a* along the outer wall 11*d* of the contact case 11.

The contact device 3 includes a first fixed terminal 14, a second fixed terminal 15, a movable contact piece 16, and the contact piece holding unit 17. The first fixed terminal 14, the second fixed terminal 15, and the movable contact piece 16 are comprised of conductive material.

The first fixed terminal 14 is formed by bending a plate-shaped member. The first fixed terminal 14 has: one end that is housed in the accommodation space 2*c*; and the other end protruding from the housing 2 in the left-right direction and exposed to the outside of the housing 2. The first fixed terminal 14 is disposed at the upper part of the first contact support portion 11*e* of the contact case 11. The first fixed terminal 14 is supported at its second surface 14*b*, to be described later, in contact with the first contact support portion 11*e* of the contact case 11.

Figure 3:
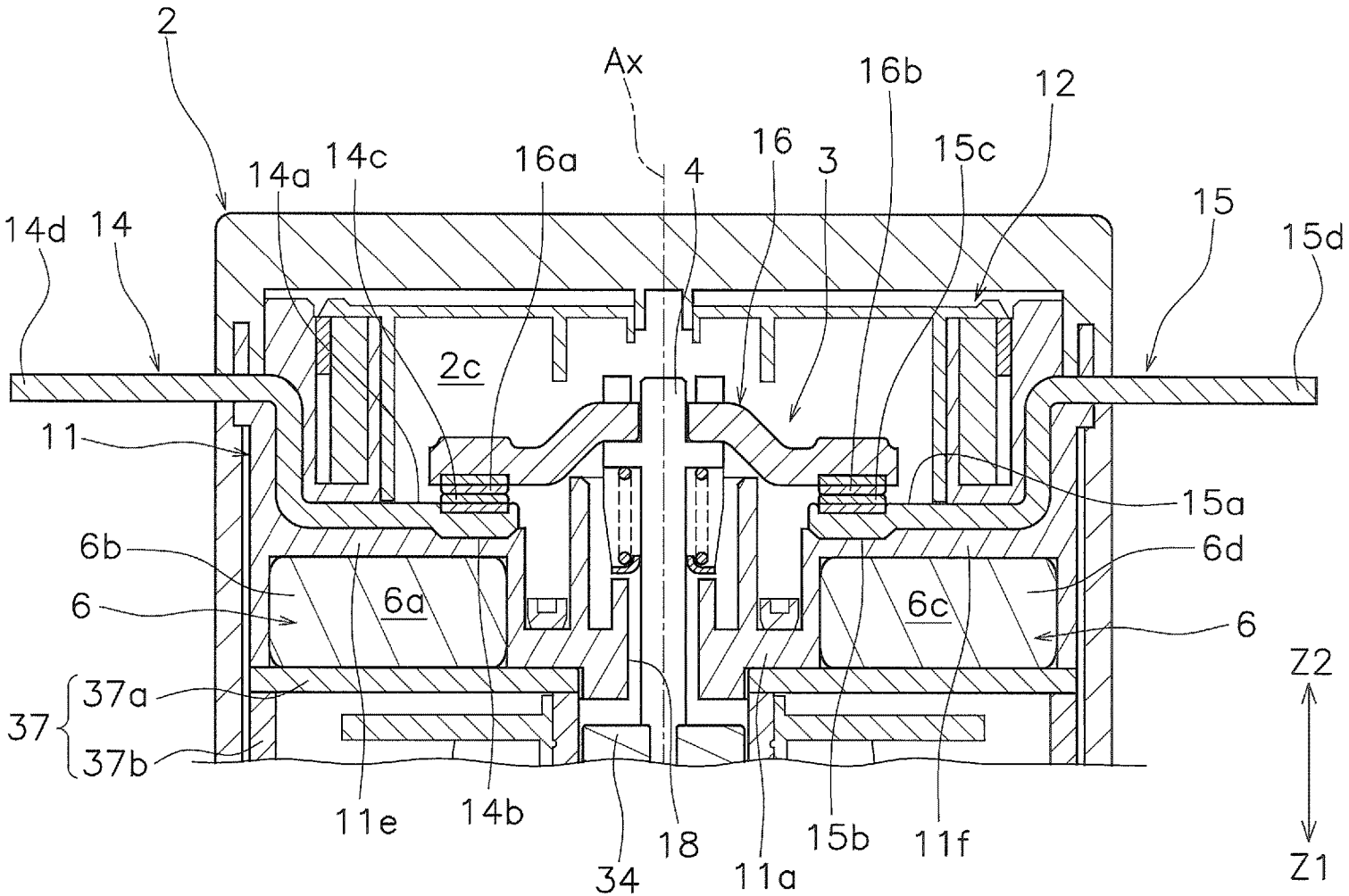
FIG. 3 is an enlarged cross-sectional view illustrating the periphery of the contact case.

FIG. 3 is an enlarged cross-sectional view illustrating the periphery of the contact case 11. As shown in FIG. 3, the first fixed terminal 14 includes a first surface 14*a*, a second surface 14*b*, a first fixed contact 14*c*, and a first external connection 14*d*. The first surface 14*a* corresponds to the surface on the separating direction Z2 side. The second surface 14*b* is opposite the first surface 14*a* and corresponds to the surface on the contact direction Z1 side. The second surface 14*b* is in contact with the first contact support portion 11*e* of the contact case 11. The contact is not necessarily direct contact, and may be indirect contact. The first fixed contact 14*c* is disposed on the first surface 14*a* in the accommodation space 2*c*.

The second fixed terminal 15 is supported by the second contact support portion 11*f* of the contact case 11 in the housing 2. The second fixed terminal 15 includes a first surface 15*a*, a second surface 15*b*, a second fixed contact 15*c*, and a second external connection 15*d*. The second fixed terminal 15 is symmetrical in shape to the first fixed terminal 14, and is therefore omitted from the description.

The movable contact piece 16 is disposed opposite the first fixed contact 14*c* and the second fixed contact 15*c* in the accommodation space 2*c*. The movable contact piece 16 is disposed above the first fixed contact 14*c* and the second fixed contact 15*c*. The movable contact piece 16 includes a first movable contact 16*a* and a second movable contact 16*b*. The first movable contact 16*a* is disposed opposite the first fixed contact 14*c* and is contactable with the first fixed contact 14*c*. The second movable contact 16*b* is disposed opposite the second fixed contact 15*c* and is contactable with the second fixed contact 15*c*. Note that FIG. 3 illustrates a state where the first movable contact 16*a* and the second movable contact 16*b* are in contact with the first fixed contact 14*c* and the second fixed contact 15*c*, respectively.

The movable contact piece 16 is movable in the contact direction Z1 in which it contacts the first fixed contact 14*c* and the second fixed contact 15*c*, and in the separating direction Z2 in which it separates from the first fixed contact 14*c* and the second fixed contact 15*c*. The contact direction Z1 is an example of the first direction, and the separating direction Z2 is an example of the second direction.

The contact direction Z1 is the direction in which the first movable contact 16*a* and the second movable contact 16*b* contact the first fixed contact 14*c* and the second fixed contact 15*c* (downward in FIG. 1). The separating direction Z2 is the direction in which the first movable contact 16*a* and the second movable contact 16*b* separate from the first fixed contact 14*c* and the second fixed contact 15*c* (upward in FIG. 1). The contact direction Z1 and the separating direction Z2 coincide with the axial direction.

The contact piece holding unit 17 holds the movable contact piece 16 via the drive shaft 4, as shown in FIG. 1. The contact piece holding unit 17 connects the movable contact piece 16 to the drive shaft 4. The contact piece holding unit 17 includes a holder 24 and a contact spring 25. The movable contact piece 16 is held in the axial direction between the upper part of the holder 24 and the flange 4*a* of the drive shaft 4. The contact spring 25 is disposed between the bottom of the holder 24 and the flange 4*a* of the drive shaft 4, and pushes the drive shaft 4 and the movable contact piece 16 toward the separating direction Z2 side.

The drive shaft 4 extends along the contact direction Z1 and the separating direction Z2. The drive shaft 4 is connected to the movable contact piece 16 via the contact piece holding unit 17. The drive shaft 4 is movable with the movable contact piece 16 in the contact direction Z1 and the separating direction Z2.

The electromagnetic drive device 5 moves the drive shaft 4 in the contact direction Z1 and the separating direction Z2 by electromagnetic force. The electromagnetic drive device 5 is disposed in a space different from the accommodation space 2*c* in the housing 2. In this embodiment, the electromagnetic drive device 5 is disposed below the contact case 11.

The electromagnetic drive device 5 includes a coil 32, a spool 33, a movable iron core 34, a fixed iron core 35, a biasing member 36, and a yoke 37.

The coil 32 is mounted on the outer circumference of the spool 33. The spool 33 includes an accommodating part 33*a*. The accommodating part 33*a* is located inside the spool 33. The accommodating part 33*a* is cylindrical and axially extends. In the axial direction, the accommodating part 33*a* overlaps the through hole 18 in the cylindrical part 11*b* of the contact case 11. The drive shaft 4 is partially disposed in the accommodating part 33*a*.

A movable iron core 34 is disposed within the accommodating part 33*a*. The movable iron core 34 is cylindrical in shape and is connected to the drive shaft 4, with the drive shaft 4 penetrating through the center in the axial direction, so that the movable iron core 34 is movable integrally with the drive shaft 4. The movable iron core 34 is movable in the axial direction together with the drive shaft 4. In this embodiment, the movable iron core 34 is guided in the axial direction by an annular iron core 38 disposed in the accommodating part 33*a*.

The fixed iron core 35 is disposed opposite the movable iron core 34 on the contact direction Z1 side of the movable iron core 34 in the accommodating part 33*a*. The fixed iron core 35 is fixed to the yoke 37.

The biasing member 36 is, for example, a coil spring and is disposed between the movable iron core 34 and the fixed iron core 35. The biasing member 36 urges the movable iron core 34 toward the separating direction Z2. Therefore, the biasing member 36 is placed between the movable iron core 34 and the fixed iron core 35 in a compressed state.

The yoke 37 includes a first yoke 37*a* and a second yoke 37*b*. The first yoke 37*a* is plate-shaped and is disposed between the bottom 11*a* of the contact case 11 and the spool 33. The first yoke 37*a* is fixed to the bottom 11*a* of the contact case 11 by a plurality of screw members not shown. The first yoke 37*a* overlaps the first contact support portion 11*e* and the second contact support portion 11*f* of the contact case 11 in the axial direction. The first yoke 37*a* overlaps with the lower portion of the cylindrical part 11*b* in the left-right direction. The first yoke 37*a* is connected to the annular iron core 38. The second yoke 37*b* has an approximately U-shape with the bottom located below the spool 33 and connected to the fixed iron core 35. The second yoke 37*b* is connected to the first yoke 37*a*, at the upper ends of the two side portions thereof.

The heat dissipation structure 6 includes a first heat dissipation space 6*a* and a first heat conduction member 6*b*, as shown in FIG. 3. The first heat dissipation space 6*a* is a space for releasing heat of the first fixed terminal 14 outside the accommodation space 2*c*, and is disposed on the second surface 14*b* side of the first fixed terminal 14. In more detail, the first heat dissipation space 6*a* is disposed on the contact direction Z1 side of the first contact support portion 11*e* of the contact case 11. The first heat dissipation space 6*a* is disposed at a position adjacent to the accommodation space 2*c* and is defined separate from the accommodation space 2*c*. In this embodiment, the accommodation space 2*c* and the first heat dissipation space 6*a* are defined by the contact case 11. The first heat dissipation space 6*a* is, for example, an approximately rectangular space that is formed on the contact direction Z1 side of the first contact support portion 11*e* when the contact case 11 is resin molded. The contact direction Z1 side of the first heat dissipation space 6*a* is covered by the first yoke 37*a*. Therefore, the first heat dissipation space 6*a* is surrounded by the first contact support portion 11*e* and the first yoke 37*a* in this embodiment.

The first heat conduction member 6*b* is a member having a higher thermal conductivity than air. The first heat conduction member 6*b* in this embodiment is preferably a non-metal and is comprised of a material such as, for example, urethane, silicon, or epoxy resin. The first heat conduction member 6*b* is disposed in at least a part of the first heat dissipation space 6*a*. The first heat conduction member 6*b* has a rectangular shape in this embodiment, and is disposed so as to fill the first heat dissipation space 6*a*. The first heat conduction member 6*b* is disposed in contact with at least one of the first contact support portion 11*e* and the first yoke 37*a*. In this embodiment, the first heat conduction member 6*b* is disposed in contact with both the first contact support portion 11*e* and the first yoke 37*a*. The first heat conduction member 6*b* may be composed of a metal. In this case, it is preferable to arrange an insulating member between the first heat conduction member 6*b* and the first yoke 37*a* so that the first heat conduction member 6*b* and the first yoke 37*a* do not come into direct contact.

The heat dissipation structure 6 further includes a second heat dissipation space 6*c* and a second heat conduction member 6*d*. The second heat dissipation space 6*c* is a space for releasing heat of the second fixed terminal 15 outside the accommodation space 2*c*, and is provided on the second surface 15*b* side of the second fixed terminal 15. The second heat conduction member 6*d* is disposed in at least a part of the second heat dissipation space 6*c*. Since the second heat dissipation space 6*c* and the second heat conduction member 6*d* are symmetrical in shape to the first heat dissipation space 6*a* and the first heat conduction member 6*b*, the description is omitted.

Next, the operation of the electromagnetic relay 100 will be described. FIG. 1 shows a state where no voltage is applied to the coil 32. While no voltage is applied to the coil 32, the biasing member 36 causes the movable iron core 34 not to move in the contact direction Z1. Thus, the first movable contact 16*a* and the second movable contact 16*b* are separated from the first fixed contact 14*c* and the second fixed contact 15*c*.

Figure 4:
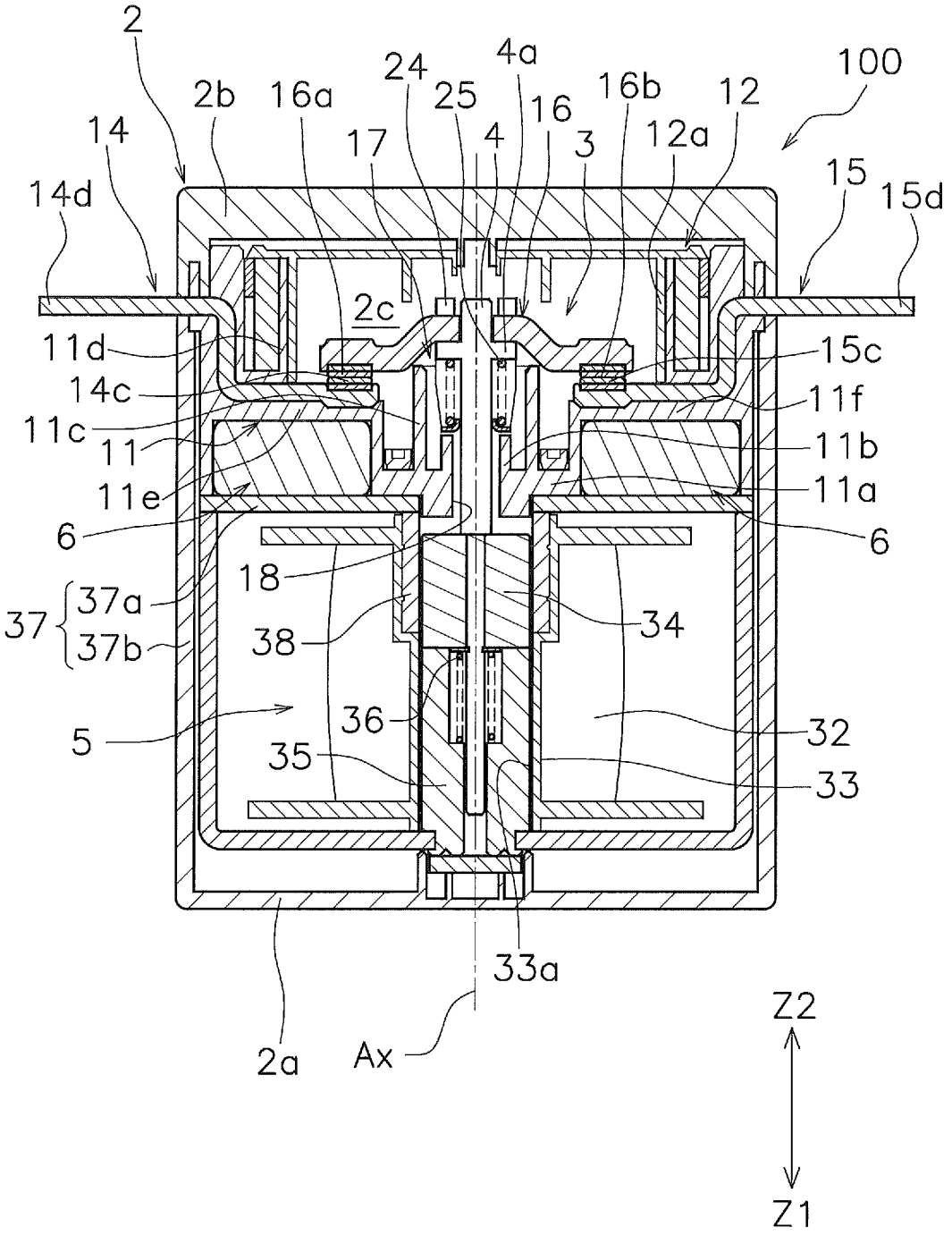
FIG. 4 is a cross-sectional view of an electromagnetic relay when a voltage is applied to the coil.

FIGS. 3 and 4 show a state where a voltage is applied to the coil 32. When a voltage is applied to the coil 32 to energize it, the electromagnetic force of the coil 32 causes the movable iron core 34 to move in the contact direction Z1 against the elastic force of the biasing member 36. With the movement of the movable iron core 34, the drive shaft 4 and the movable contact piece 16 move in the contact direction Z1, and the first movable contact 16*a* and the second movable contact 16*b* contact the first fixed contact 14*c* and the second fixed contact 15*c*.

When the application of the voltage to the coil 32 is stopped, the movable iron core 34 moves in the separating direction Z2 by the elastic force of the biasing member 36, and the first movable contact 16*a* and the second movable contact 16*b* enters a state where they are separate from the first fixed contact 14*c* and the second fixed contact 15*c*.

In the electromagnetic relay 100 of this embodiment, while the first movable contact 16*a* and the second movable contact 16*b* are in contact with the first fixed contact 14*c* and the second fixed contact 15*c*, i.e., during energization, the heat of the first fixed terminal 14, the second fixed terminal 15, and the movable contact piece 16 is efficiently dissipated outside the accommodation space 2*c* by the heat dissipation structure 6. Specifically, the heat of the first fixed terminal 14 can be efficiently dissipated outside the accommodation space 2*c* by the first heat dissipation space 6*a* and the first heat conduction member 6*b*. Further, since the first heat conduction member 6*b* is arranged in contact with the first contact support portion 11*e* and the first yoke 37*a*, the heat of the first fixed terminal 14 during energization can be efficiently dissipated to the first yoke 37*a*. Furthermore, the heat of the movable contact piece 16 during energization can be efficiently dissipated outside the accommodation space 2*c* via the first fixed terminal 14. Note that the heat of the second fixed terminal 15 during energization can be dissipated outside the accommodation space 2*c* by the second heat dissipation space 6*c* and the second heat conduction member 6*d*.

An embodiment of the electromagnetic relay according to one aspect of the present invention has been described above. The present invention, however, is not limited to the above embodiment, and various changes can be made without departing from the gist of the present invention. For example, the configuration of the electromagnetic drive device 5 may be changed. The shapes or arrangements of the housing 2, contact case 11, contact cover 12, and yoke 37 may be changed.

Figure 5:
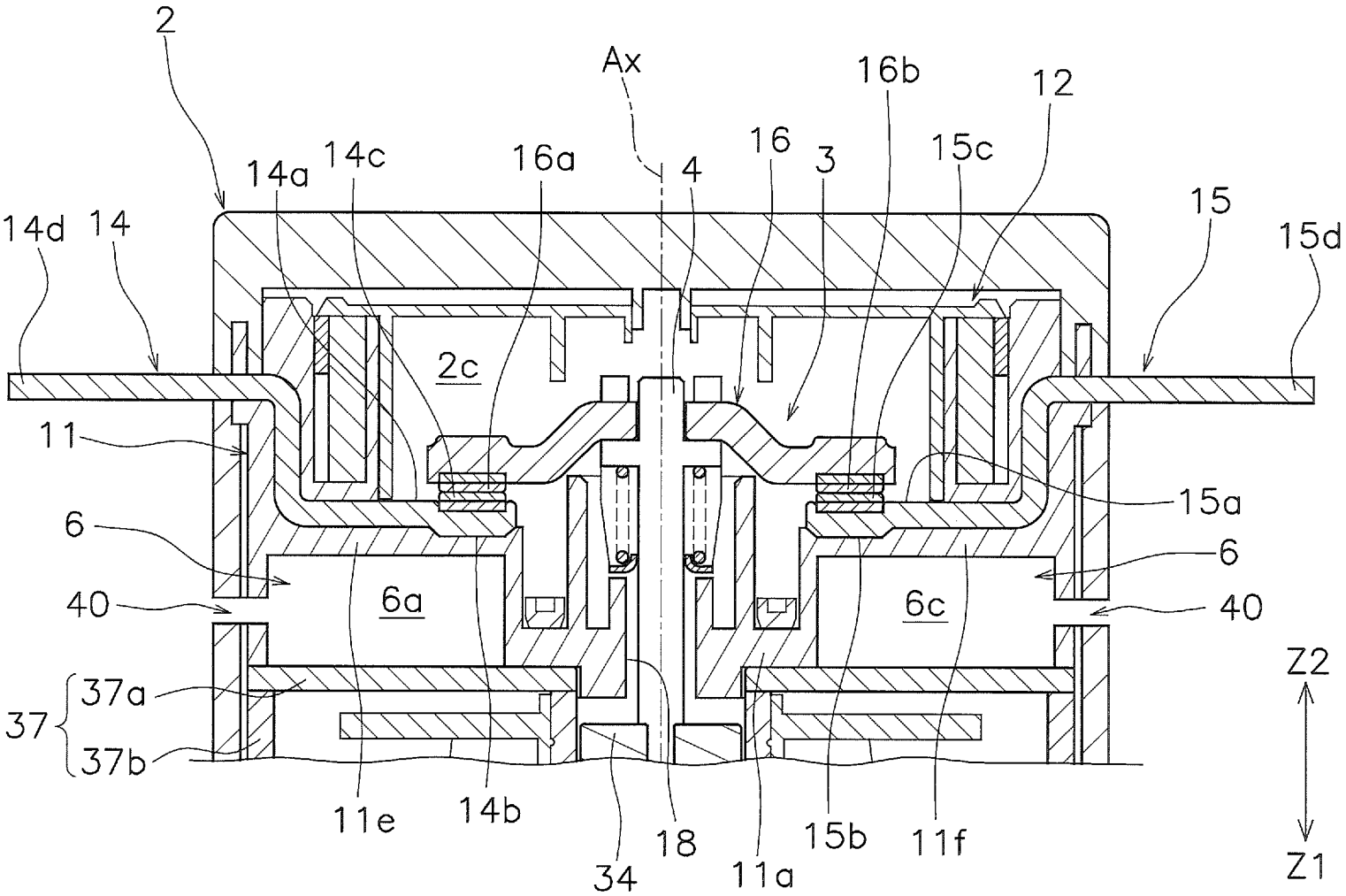
FIG. 5 is an enlarged cross-sectional view illustrating the periphery of a contact case according to a first modification.

FIG. 5 is an enlarged cross-sectional view illustrating the periphery of the contact case 11 according to a first modification. The heat dissipation structure 6 of the first modification further includes the vent 40 connecting the first heat dissipation space 6*a* to the outside of the housing 2. The heat dissipation structure 6 of the first modification does not include the first heat conduction member 6*b* and the second heat conduction member 6*d*. The other configurations are the same as in the above embodiment.

The vent 40 has a configuration to penetrate the contact case 11 and the case 2*a* of the housing 2 in the left-right direction. In this embodiment, the vent 40 is located at a position overlapping with the first heat dissipation space 6*a* in the left-right direction. With the vent 40, the heat of the first fixed terminal 14 can be efficiently dissipated through the first heat dissipation space 6*a* to the outside of the accommodation space 2*c*. The vent 40 also resides on the second fixed terminal 15 side, so that the vent 40 connects the second heat dissipation space 6*c* to the outside of the housing 2.

Figure 6:
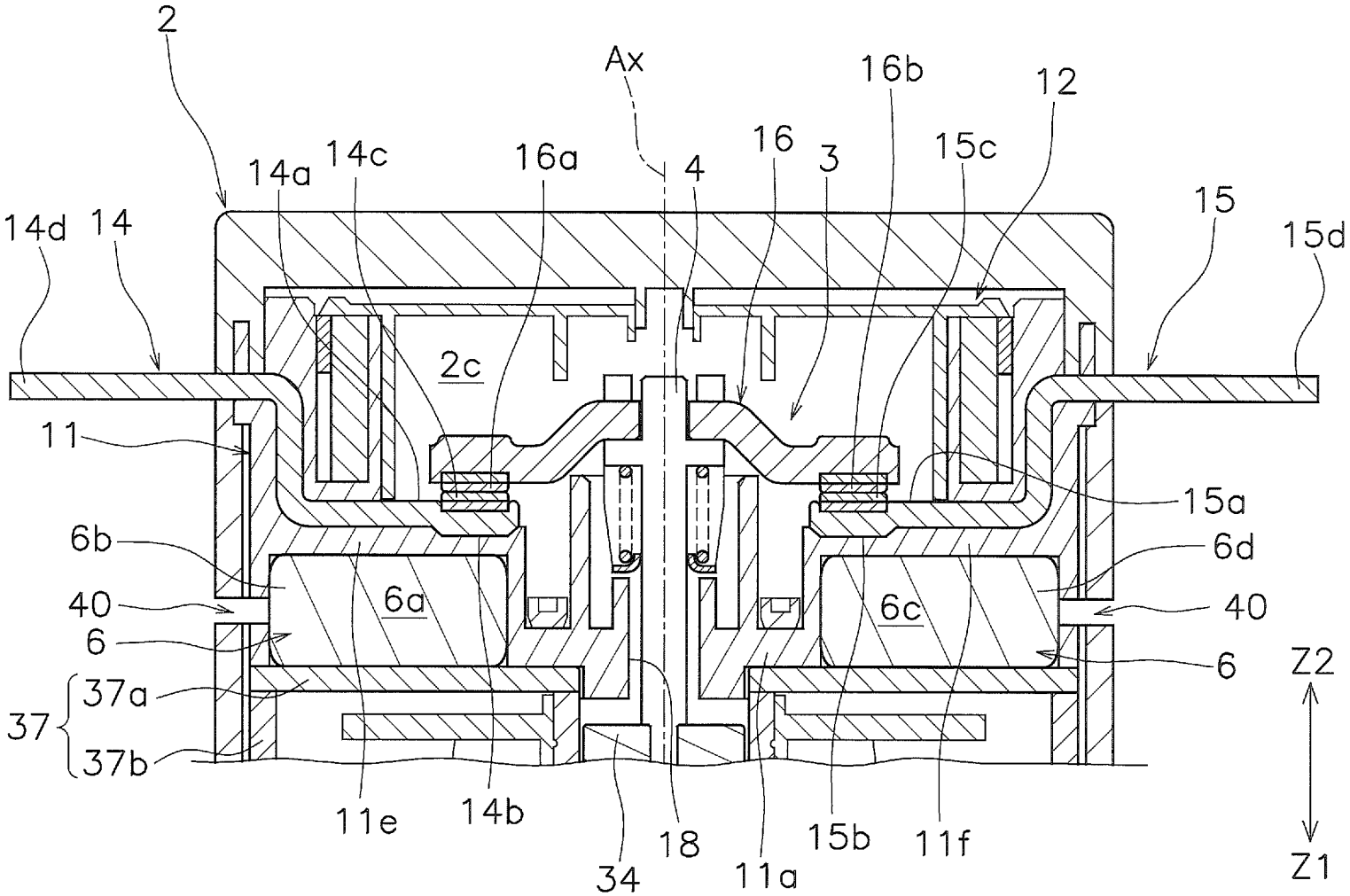
FIG. 6 is an enlarged cross-sectional view illustrating the periphery of a contact case according to a second modification.

FIG. 6 is an enlarged cross-sectional view illustrating the periphery of the contact case 11 according to a second modification. The heat dissipation structure 6 according to the second modification includes the first heat dissipation space 6*a*, the first heat conduction member 6*b*, and the vent 40. In this case, the first heat conduction member 6*b* and the vent 40 enable the heat of the first fixed terminal 14 to be released more efficiently outside the accommodation space 2*c*. The positions and shapes of the heat conduction members 6*b*, 6*d* and the vent 40 can be changed as needed.

Figure 7:
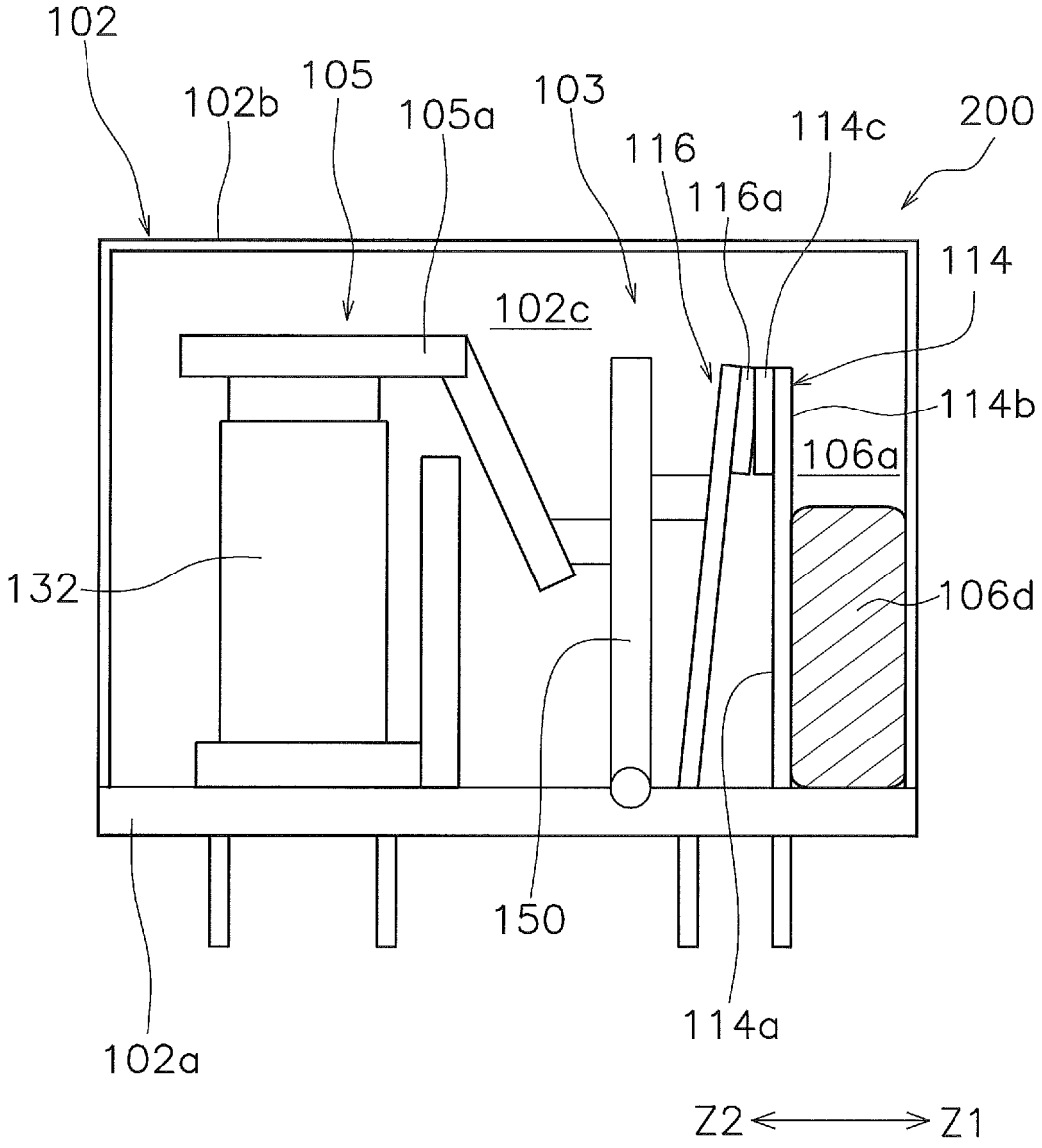
FIG. 7 is a schematic side view of an electromagnetic relay according to a fourth modification.
Figure 8:
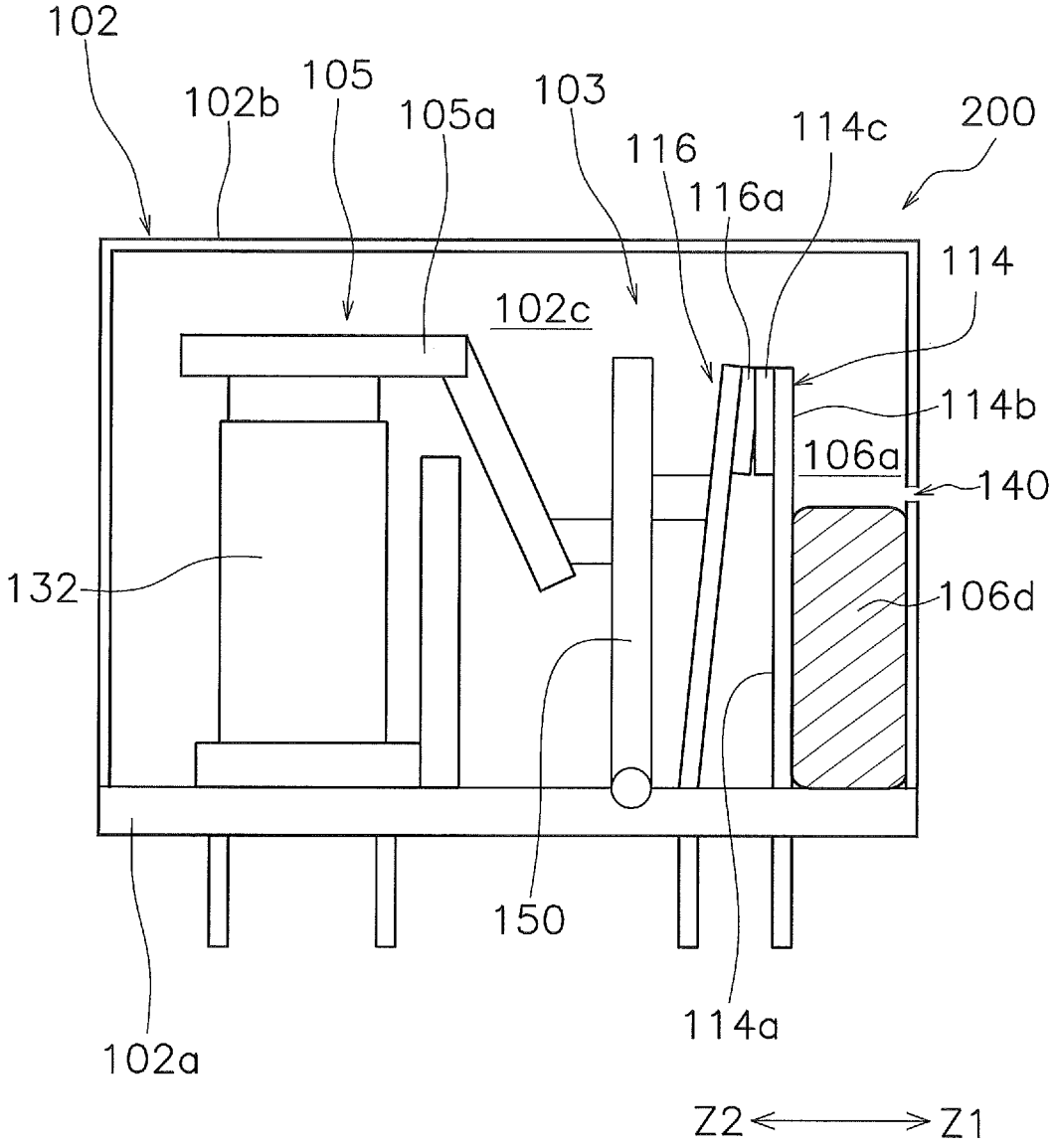
FIG. 8 is a schematic side view of an electromagnetic relay according to a fourth modification.

FIG. 7 is a schematic side view of an electromagnetic relay according to a fourth modification. The electromagnetic relay 200 according to the fourth modification is a general hinge-type electromagnetic relay. The electromagnetic relay 200 includes a housing 102, a contact device 103, an electromagnetic drive device 105, and a heat dissipation structure 106. FIG. 8 shows a state where a voltage is applied to the coil 132 of the electromagnetic drive device 105. The operation of the electromagnetic relay 200 will be omitted since it has the same structure as conventional ones.

The housing 102 includes a base 102*a*, a case 102*b*, and an accommodation space 102*c*. In the fourth modification, the accommodation space 102*c* is surrounded by the base 102*a* and the case 102*b*.

The contact device 103 is accommodated in the accommodation space 102*c*. The contact device 103 includes a fixed terminal 114 and a movable contact piece 116. The fixed terminal 114 is supported by the base 102*a*. The fixed terminal 114 includes a fixed contact 114*c* disposed on the first surface 114*a*. A movable contact piece 116 is disposed opposite the fixed terminal 114 and is supported by the base 102*a*. The movable contact piece 116 is composed of a conductive and elastically deformable plate spring. The movable contact piece 116 includes a movable contact 116*a* that is configured to contact the fixed contact 114*c*.

The electromagnetic drive device 105 includes a movable iron piece 105*a* that is approximately L-shaped. The movable iron piece 105*a* is capable of pressing a card 150 in the contact direction Z1, the card 150 being rotatably supported at the bottom of the housing 102.

The heat dissipation structure 106 includes a heat dissipation space 106*a* and a heat conduction member 106*b*. The heat dissipation space 106*a* is provided on the second surface 114*b* side opposite the first surface 114*a* of the fixed terminal 114, and dissipates the heat of the fixed terminal 114 outside the accommodation space 102*c*. The heat dissipation space 106*a* is surrounded by the case 102*b* on the contact direction Z1 side. At least a part of the heat dissipation space 106*a* on the separating direction Z2 side is surrounded by the second surface 114*b* of the fixed terminal 114.

The heat conduction member 106*b* is a member that has a higher thermal conductivity than air. The heat conduction member 106*b* is preferably a non-metal and is comprised of a material such as, for example, urethane, silicon, or epoxy resin. The heat conduction member 106*b* is disposed in at least a part of the heat dissipation space 106*a*. The heat conduction member 106*b* is disposed so as to contact at least one of the housing 102 and the fixed terminal 114. In the present embodiment, the heat conduction member 106*b* is disposed in contact with both the housing 102 and the fixed terminal 114. The heat conduction member 106*b* may be composed of a metal. When the heat conduction member 106*b* is composed of a metal, preferably a gap is formed between the heat conduction member 106*b* and the fixed terminal 114, or an insulating member is placed between the heat conduction member 106*b* and the fixed terminal 114.

As shown in FIG. 8, the heat dissipation structure 106 may further include a vent 140. The vent 140 connects the heat dissipation space 106*a* to the outside of the housing 102. In this embodiment, the vent 140 passes through the case 102*b* of the housing 102. The vent 140 is preferably located at a position overlapping with the fixed terminal 114 in the separating direction Z2. In the case where the heat dissipation structure 106 includes the vent 140, the heat dissipation structure 106 need not necessarily include the heat conduction member 106*b*. The positions and shapes of the heat conduction member 106*b* and the vent 140 can be changed as needed. For example, the vent 140 may be located at a position where it overlaps the fixed terminal 114 in the separating direction Z2.

INDUSTRIAL APPLICABILITY

The present invention can provide an electromagnetic relay that is able to efficiently dissipate the heat of the fixed terminal and movable contact piece during energization.

REFERENCE NUMERALS

2 Housing
2*c* Accommodation space
4 Drive shaft
5 Electromagnetic drive device
6 Heat dissipation structure
6*a* First heat dissipation space (An example of heat dissipation space)
6*b* First heat conduction member (An example of heat conduction member)
6*c* Second heat dissipation space (An example of heat dissipation space)
6*d* Second heat conduction member (An example of heat conduction member)
11 Contact case
11*a* Bottom
11*e* First contact support (An example of a contact support part)
11*f* Second contact support (An example of contact support)
14 First fixed terminal (An example of fixed terminal)
14*a* First surface
14*b* Second surface
14*c* First fixed contact (An example of fixed contact)
15 Second fixed terminal (An example of fixed terminal)
15*a* First surface
15*b* Second surface
15*c* Second fixed contact (An example of fixed contact)
16 Movable contact piece
16*a* First movable contact (An example of movable contact)
16*b* Second movable contact (An example of movable contact)
37*a* First yoke (An example of yoke)
40 Vent
100 Electromagnetic relay
102 Housing
102*c* Accommodation space
105 Electromagnetic drive device
106 Heat dissipation structure
106*a* Heat dissipation space
106*b* Heat conduction member
114 Fixed terminal
114*a* First surface
114*b* Second surface
114*c* Fixed contact
116 Movable contact piece
116*a* Movable contact
200 Electromagnetic relay
Z1 Contact direction (An example of First direction)
Z2 Separating direction (An example of Second direction)

The invention claimed is:

1. An electromagnetic relay comprising:

a fixed terminal having a first surface and a second surface opposite to the first surface, the fixed terminal including a fixed contact disposed on the first surface;

a movable contact piece including a movable contact configured to contact the fixed contact;

a housing including an accommodation space configured to accommodate a portion of the fixed terminal, the fixed contact, and the movable contact piece;

a heat dissipation structure including a heat dissipation space provided on a second surface side of the fixed terminal, the heat dissipation space configured to dissipate heat of the fixed terminal to an outside of the accommodation space;

a contact case having a bottom, the contact case separating the accommodation space and the heat dissipation space from each other;

a drive shaft movable with the movable contact piece in a first direction in which the movable contact contacts the fixed contact and in a second direction in which the movable contact separates from the fixed contact; and an electromagnetic drive device configured to move the drive shaft in the first direction and the second direction, wherein the contact case includes a contact support portion disposed on a second direction side with respect to the bottom, the contact support portion configured to support the fixed terminal, the fixed terminal is, at the second surface, supported by the contact support portion of the contact case, and the heat dissipation space is disposed in the housing and disposed on a first direction side with respect to the contact support portion.

2. The electromagnetic relay according to claim 1, wherein the heat dissipation structure further includes a heat conduction member disposed in the heat dissipation space, the heat conduction member having a higher thermal conductivity than air.

3. The electromagnetic relay according to claim 2, wherein the heat conduction member is disposed in contact with at least one of the housing or the fixed terminal.

4. The electromagnetic relay according to claim 1, wherein the heat dissipation structure further includes a vent configured to connect the heat dissipation space to an outside of the housing.

5. The electromagnetic relay according to claim 1, wherein the electromagnetic drive device includes a yoke disposed on the first direction side with respect to the heat dissipation space, and the heat dissipation space is surrounded by the contact support portion of the contact case and the yoke.

6. The electromagnetic relay according to claim 2, wherein the electromagnetic drive device includes a yoke disposed on the first direction side with respect to the heat dissipation space, and the heat conduction member is disposed in contact with at least one of the contact case or the yoke.

7. The electromagnetic relay according to claim 6, wherein the heat dissipation structure further includes a vent configured to connect the heat dissipation space to an outside of the housing.

8. The electromagnetic relay according to claim 1, wherein the fixed contact overlaps with the contact support portion and the heat dissipation space as viewed along the first direction and the second direction.

* * * * *